US006211827B1

(12) United States Patent
Chang

(10) Patent No.: US 6,211,827 B1
(45) Date of Patent: Apr. 3, 2001

(54) ANTENNA FOR RADIO TRANSMITTER AND RECEIVER

(76) Inventor: Eung-Soon Chang, 103-904 Samik Ceramic Apt., 1038 Mansoo-dong, Namdong-gu, Inchon-shi (KR)

( * ) Notice: Subject to any disclaimer, the term of this patent is extended or adjusted under 35 U.S.C. 154(b) by 0 days.

(21) Appl. No.: 09/341,564

(22) PCT Filed: Jan. 29, 1997

(86) PCT No.: PCT/KR97/00017

§ 371 Date: Jul. 13, 1999

§ 102(e) Date: Jul. 13, 1999

(87) PCT Pub. No.: WO98/33231

PCT Pub. Date: Jul. 30, 1998

(51) Int. Cl.[7] ..... H01Q 1/24
(52) U.S. Cl. ..... 343/702; 343/906
(58) Field of Search ..... 343/702, 906, 343/895, 715, 900, 901; H01Q 1/24

(56) References Cited

U.S. PATENT DOCUMENTS 5,880,696 * 3/1999 Koleda ..... 343/702
5,907,306 * 5/1999 Karabinis et al. ..... 343/702
5,926,138 * 7/1999 Eerikainen ..... 343/702

* cited by examiner

*Primary Examiner*—Hoanganh Le
(74) *Attorney, Agent, or Firm*—R. Neil Sudol; Henry D. Coleman; William J. Sapone

(57) ABSTRACT

An antenna assembly includes an integral or unitary support portion connectable to an end to a radio transmitter and receiver and formed at an opposite end with a circular groove, an antenna, an antenna spring disposed inside the antenna and connected at a first end thereto, and an elongate connection member. The connection member is provided with a longitudinally extending elongate hole or slot. One end of the connection member is connected to a second end of the spring opposite the first end. Another end of the connection member is inserted in an elastic or snap-lock fit in the circular groove.

6 Claims, 3 Drawing Sheets

ANTENNA FOR RADIO TRANSMITTER AND RECEIVER

TECHNICAL FIELD

The present invention relates to an improved antenna for a radio transmitter and receiver, and particularly to an improved antenna for a radio transmitter and receiver radios such as a Personal Communication Service (PCS) system.

BACKGROUND ART

Generally, a radio transmitter and receiver is used for performing a radio transmission and receiving operation, whereby a high frequency signal outputted from a modulator is transmitted to an antenna of the radio transmitter and is transmitted therefrom to a remote radio transmitter and receiver, or the thusly transmitted signal is received through another antenna.

In order to improve a radio transmitting and receiving characteristic of the radio transmitter and receiver, the impedances of the antenna and the radio transmitter and receiver must be accurately matched in accordance with a frequency to be transmitted and received, and a radio loss must be necessarily reduced.

FIG. 1 is a perspective view illustrating a lower portion of a conventional antenna.

As shown therein, there is provided an antenna 1 which is rotatably fixed to one end of a support portion 2, with the antenna 1 and the support portion 2 being separable.

FIG. 2 is a perspective view illustrating a lower portion of another conventional antenna assembly As shown therein, an antenna 5 is threadably coupled to a support portion 3 by using an engaging member 4, with the antenna 5 and the support portion 2 being separable.

However, in such conventional antennas, since the support portions 2 and 3 for supporting the antennas 1 and 5 are not integral, the antenna assemblies are very difficult to fabricate. In addition, in order to fix the antennas 1 and 5 to the support portions 2 and 3, a hole or a screw portion must be additionally formed in the support portions 2 and 3, for thus fixing the antennas 1 and 5 thereto, so that the constructions thereof become complicated, whereby the fabrication cost is increased.

SUMMARY OF THE INVENTION

Accordingly, it is an object of the present invention to provide an antenna for a radio transmitter and receiver which overcomes the aforementioned problems encountered in the conventional radio transmitter and receiver antenna assemblies.

It is another object of the present invention to provide an antenna for a radio transmitter and receiver which is capable of more efficiently transmitting and receiving radios signals by providing the antenna in a radio transmitter and receiver such as a Personal Communication Service (PCS) system.

To achieve the above objects, there is provided an antenna for a radio transmitter and receiver which includes an integral type support portion having a circular groove formed in one end thereof, and a connection member having a circular insertion portion and an elongated hole, whereby the insertion portion of the connection member is elastically and separably inserted into the groove of the support portion.

To achieve the above objects, there is provided an antenna for a radio transmitter and receiver which includes a connection member is rotatable by 360° in the groove of the support portion.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

MODES FOR CARRYING OUT THE INVENTION

Figure 1:
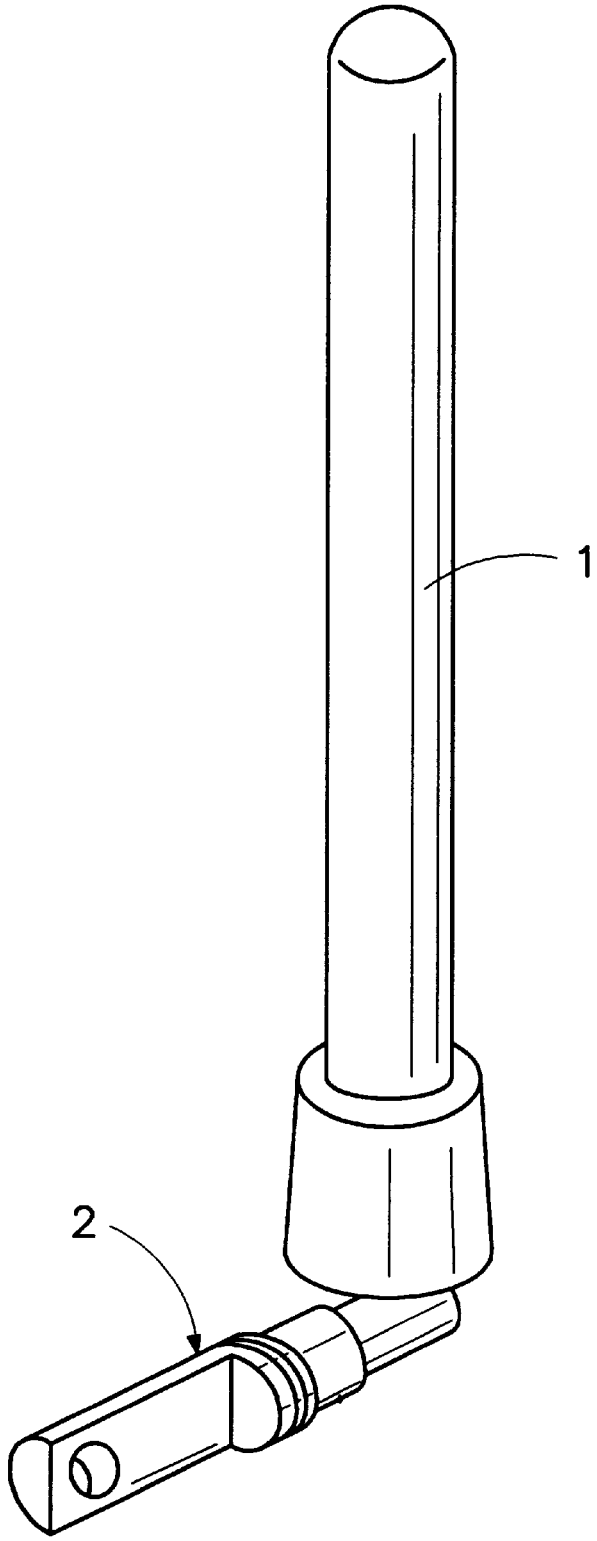
FIGS. 1 and 2 are perspective views illustrating respective conventional antennas.
Figure 2:
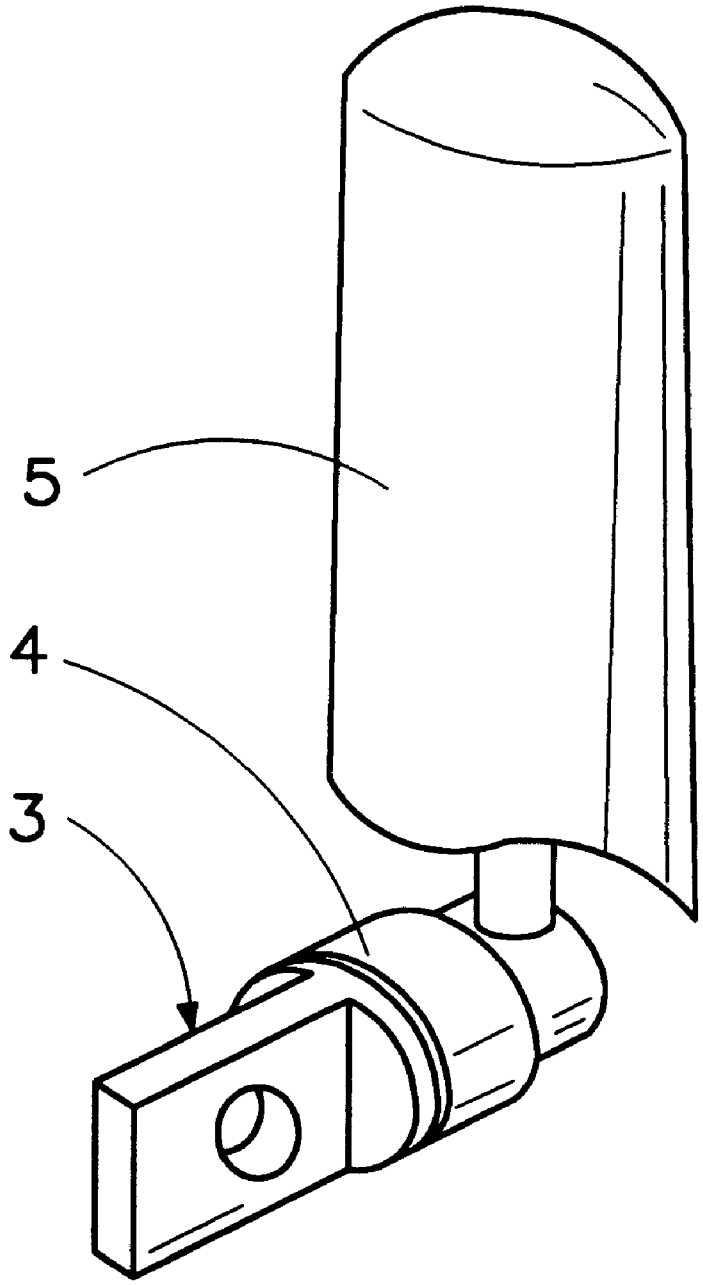
Figure 3:
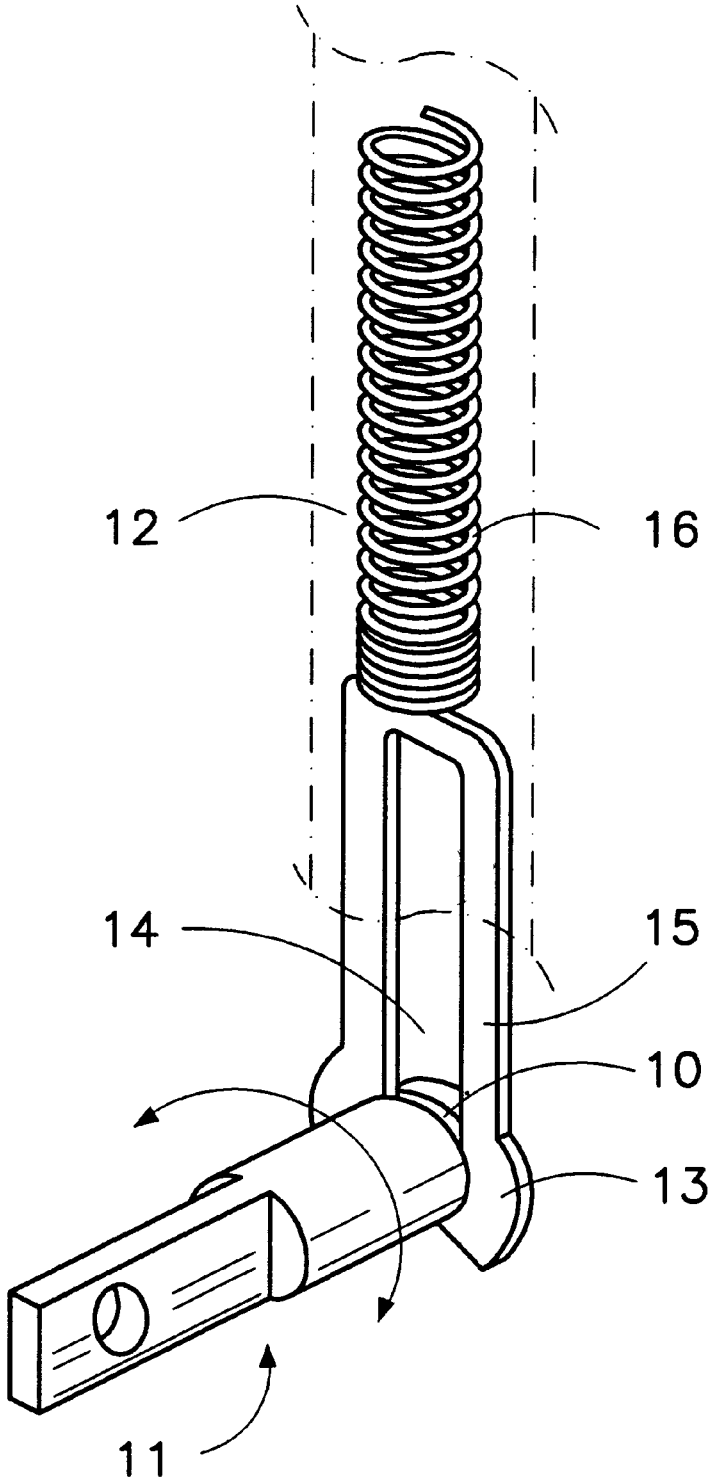
FIG. 3 is a perspective view illustrating a radio transmitter and receiver antenna according to the present invention.

As shown in FIG. 3, a support portion 11 having a circular groove 10 formed in one end thereof is an integral or unitary element. A connection member 15 having a circular insertion portion 13 and an elongated hole 14 is formed in a lower end of an antenna 12. The insertion portion 13 of the connection member 15 is inserted in an elastic or snap-lock fit into the groove 10. In the drawings, reference numeral 16 denotes a spring.

The insertion portion 13 of the connection member 15 has a cut-away portion not shown for easier insertion into the groove 10.

Since the support insertion 11 of the antenna 12 is integrally formed, the insertion portion 13 of the connection member 15 is elastically inserted into the groove 10 formed in one end of the support portion 11, both ends of the insertion portion 13 becoming widened under elastic forces from the portion 10, for thus easily inserting the insertion portion 13 into the hole portion. After the insertion portion 13 of the connection member 15 is inserted into the groove 10, the insertion portion 13 is returned to its original shape by the restoring force itself, thus preventing the connection member 15 from escaping from the groove 10.

In addition, to the manner of coupling, the connection member 15 and the groove 10, the connection member 15 is rotatable through 360°, for thus easily adjusting the position of the antenna 12.

As described above, in the antenna for a radio transmitter and receiver according to the present invention, it is possible to easily fabricate the antenna and reduce the fabrication cost. In addition, it is possible to rotate the antenna 12 through 360°, thus easily adjusting the position of the antenna 12.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An antenna assembly for a radio transmitter and receiver, comprising:

an integral type support portion having a circular groove portion formed in one end thereof, another end of said integral type support portion being connected to the radio transmitter and receiver; and a connection member having a circular insertion portion pivotally connected to the circular groove portion and an elongate hole extending from said circular groove portion to form an elastic assembly with the circular groove portion, one end of said connection member being connected to an antenna spring.

2. The antenna of claim 1 wherein said connection member is rotatable through an angle of 360° in said groove portion.

3. An antenna assembly comprising:

an integral or unitary support portion connectable at an end to a radio transmitter and receiver and formed at an opposite end with a circular groove;

an antenna;

an antenna spring disposed inside said antenna and connected at a first end thereto; and an elongate connection member provided with a longitudinally extending elongate hole or slot, one end of said connection member being connected to a second end of said spring opposite said first end, another end of said connection member being inserted in an elastic or snap-lock fit in said circular groove.

4. The antenna of claim 3 wherein said connection member is rotable through an angle of 360° in said groove portion.

5. The antenna of claim 3 wherein at least a portion of said connection member is inserted in said antenna.

6. The antenna of claim 3 wherein said spring is a coil spring.

* * * * *